US006401766B1

(12) United States Patent
Ishikawa et al.

(10) Patent No.: US 6,401,766 B1
(45) Date of Patent: Jun. 11, 2002

(54) BINDING MACHINE FOR REINFORCING BARS

(75) Inventors: Noboru Ishikawa; Osamu Itagaki; Syuichi Ishii, all of Tokyo (JP)

(73) Assignee: Max Co., Ltd., Tokyo (JP)

( * ) Notice: Subject to any disclaimer, the term of this patent is extended or adjusted under 35 U.S.C. 154(b) by 0 days.

(21) Appl. No.: 09/624,140

(22) Filed: Jul. 21, 2000

(30) Foreign Application Priority Data

Jul. 23, 1999 (JP) ..... 11-209930
Nov. 17, 1999 (JP) ..... 11-327496

(51) Int. Cl.[7] ..... B21F 23/00
(52) U.S. Cl. ..... 140/119; 140/57
(58) Field of Search ..... 140/57, 93 A, 140/119

(56) References Cited

U.S. PATENT DOCUMENTS 3,587,668 A * 6/1971 Ward ..... 140/119
4,252,157 A * 2/1981 Ohnishi ..... 140/119
4,362,192 A * 12/1982 Furlong et al. ..... 140/119
5,613,530 A 3/1997 Kincel et al. ..... 140/119
5,694,983 A * 12/1997 Kusakari et al. ..... 140/119

FOREIGN PATENT DOCUMENTS

EP 0 731 238 A1 9/1996 ..... E04G/21/12
EP 0 751 270 A1 1/1997 ..... E04G/21/12

* cited by examiner

*Primary Examiner*—Lowell A. Larson
(74) *Attorney, Agent, or Firm*—Morgan, Lewis & Bockius LLP

(57) ABSTRACT

A binding machine for reinforcing bars comprising a binding machine body, a bending guide arm, a feed adjustment mechanism, and a twisting mechanism. The bending guide arm is arranged at an end of the binding machine body. A binding wire is sent outside reinforcing bars from the bending guide arm and is formed into a loop, and then a portion of the loop is twisted by the twisting mechanism so as to bind the reinforcing bars. The feed adjustment mechanism adjusts a feed of the binding wire according to one of a diameter of the reinforcing bars and a diameter of the loop of the binding wire wound round the reinforcing bars.

12 Claims, 11 Drawing Sheets

BINDING MACHINE FOR REINFORCING BARS

BACKGROUND OF THE INVENTION

1. Field of the Invention

The present invention relates to a binding machine for reinforcing bars which adjusts a feed of a binding wire according to the diameter of the reinforcing bars to be bound or the diameter of the loop of the binding wire wound round the reinforcing bars.

Furthermore, the present invention also relates to a binding machine for reinforcing bars in which the diameter of the reinforcing bars to be bound is discriminated and both a feed and a binding force of a wire necessary for binding are determined according to the diameter of the reinforcing bars.

2. Description of the Related Art

In general, in a binding machine for reinforcing bars, a binding wire is sent outside the reinforcing bars from a bending guide arm arranged at an end of a binding machine body so that the binding wire can be formed into a loop, and a portion of the loop is twisted so as to bind the reinforcing bars. In this binding machine for reinforcing bars, a feed of the binding wire is set constant at all times. That is, even if the reinforcing bars are thick or thin, the binding wire is sent out from the end of the guide so that it can be wound round the reinforcing bars three times. After the binding wire has been sent out, a rear end of the binding wire is cut off from the binding wire on the binding machine body side, and a portion of the binding wire, which is wound round in a loop-shape, is twisted by a twisting means arranged on the binding machine body side.

In this connection, the binding wire is sent out so that both end portions of the binding wire can be located at positions on the opposite side to the twisting section. The reason is described as follows. When the binding wire is wound round the reinforcing bars three times in such a manner that both end portions of the binding wire are located on the opposite side to the twisting side of the binding machine, the number of the binding wires on the twisting side becomes four (the number of the binding wires on the opposite side except for both end portions becomes three). Therefore, the reinforcing bars can be strongly twisted.

However, when the reinforcing bars are bound by the binding wire of the same length irrespective of the diameter of the reinforcing bars, as shown in FIG. 12(*a*), in the case where the diameter of reinforcing rod "a" is large, height h1 from the end of wire "b" to reinforcing rod "a" is relatively small. However, as shown in FIG. 12(*b*), in the case where the diameter of reinforcing rod "a" is small, height h2 from the end of wire "b" to reinforcing rod "a" becomes relatively large.

The same thing can be seen in the case where tensile strength of the binding wire is changed according to the condition of use. When the binding wire is wound round the reinforcing bars, it is curled by the action of the bending guide arm. In this case, whether the bending wire can be easily curled or not is decided by the tensile strength of the bending wire. In accordance with that, the diameter of the loop of the bending wire is changed. Since a feed of the binding wire is constant, as shown in FIG. 13, when the diameter of the loop is changed, positions of end portions "p", "q" of respective wires b1, b2 are changed according to the tensile strength. Accordingly, even if the diameters of the reinforcing bars to be bound are the same, when the diameter of the loop is large, height h3 from the end of wire "b1" to reinforcing bar "a" is small as shown in FIG. 14(*a*). On the other hand, when the diameter of the loop is small, height h4 from the end of wire "b2" to reinforcing bar "a" becomes large as shown in FIG. 14(*b*).

When height from the end of wire "b," "b1" or "b2" to reinforcing bar "a" becomes large as described above, the following problems may be encountered. When concrete 30 is placed after the reinforcing bars have been bound by the binding wire, height h2, h4 of the end portion of wire "b," or "b2" becomes larger than thickness W of concrete in some times. In this case, the end portion of the binding wire is exposed from the surface of cured concrete. Accordingly, the exposed portion of the binding wire comes into contact with air and corrodes. When this corrosion spreads inside the concrete, the concrete tends to deteriorate.

As another aspect of a conventional binding machine for reinforcing bars, it is noted that a binding wire is sent in a loop-shape to the outside of the reinforcing bars from a bending arm which is arranged at an end of the binding machine body, and a portion of the loop is held by a twisting hook and twisted by rotating the twisting hook until the fastening force (torque) reaches a predetermined value, so that the reinforcing bars can be bound by a constant torque at all times. In this case, since the diameter of the reinforcing bar is stipulated by the standard, as long as a feed and a fastening torque of the wire are set according to the reinforcing bar of the maximum diameter, it is possible to bind the reinforcing bars of different diameters.

However, the following problems may be encountered in the binding machine of the prior art. Since the feed of the binding wire is always constant irrespective of the diameter of the reinforcing bar, a quantity of the wire to be used is constant even if the diameter of the reinforcing bar is small or large. Further, the twisting hook must be rotated until the fastening torque reaches a constant value. In the case of binding thin reinforcing bars, the twisting hook must be rotated over a longer period of time than the case of binding thick reinforcing bars. Accordingly, the binding wire is wasted, and the twisting hook must be operated over a long period of time.

SUMMARY OF THE INVENTION

Accordingly, It is a first object of the present invention to solve the above problems and provide a binding machine for reinforcing bars capable of reducing the height from the end of the binding wire to the reinforcing bars after binding by adjusting a feed of the binding wire according to the diameter of the reinforcing bars and the diameter of the loop.

In order to solve the above problems, the present invention provides a binding machine for reinforcing bars in which a binding wire is sent outside the reinforcing bars from a bending guide arm arranged at an end of the binding machine body so that the binding wire can be formed into a loop and then a portion of the loop is twisted so as to bind the reinforcing bars, comprising a feed adjustment mechanism for adjusting a feed of the binding wire according to the diameter of the reinforcing bars or the diameter of the loop of the binding wire wound round the reinforcing bars.

Furthermore, it is a second object of the present invention to provide a binding machine for reinforcing bars capable of enhancing the efficiency of binding by reducing a quantity of the binding wire to be used and also by reducing the binding time when the quantity of the binding wire to be fed is automatically adjusted according to the diameter of the reinforcing bar and the binding force is adjusted at the same time.

In order to solve the above problems, the present invention provides a binding machine for reinforcing bars in which a binding wire is sent outside the reinforcing bars from a bending guide arm arranged at an end of the binding machine body so that the binding wire can be formed into a loop and then a portion of the loop is twisted so as to bind the reinforcing bars, comprising a discriminating mechanism for discriminating the diameter of the reinforcing bars arranged at an end of the binding machine body, wherein a feed and a binding force of the wire is controlled according to the result of discrimination conducted by the discriminating mechanism.

DETAILED DESCRIPTION OF THE PREFERRED EMBODIMENTS

Figure 1:
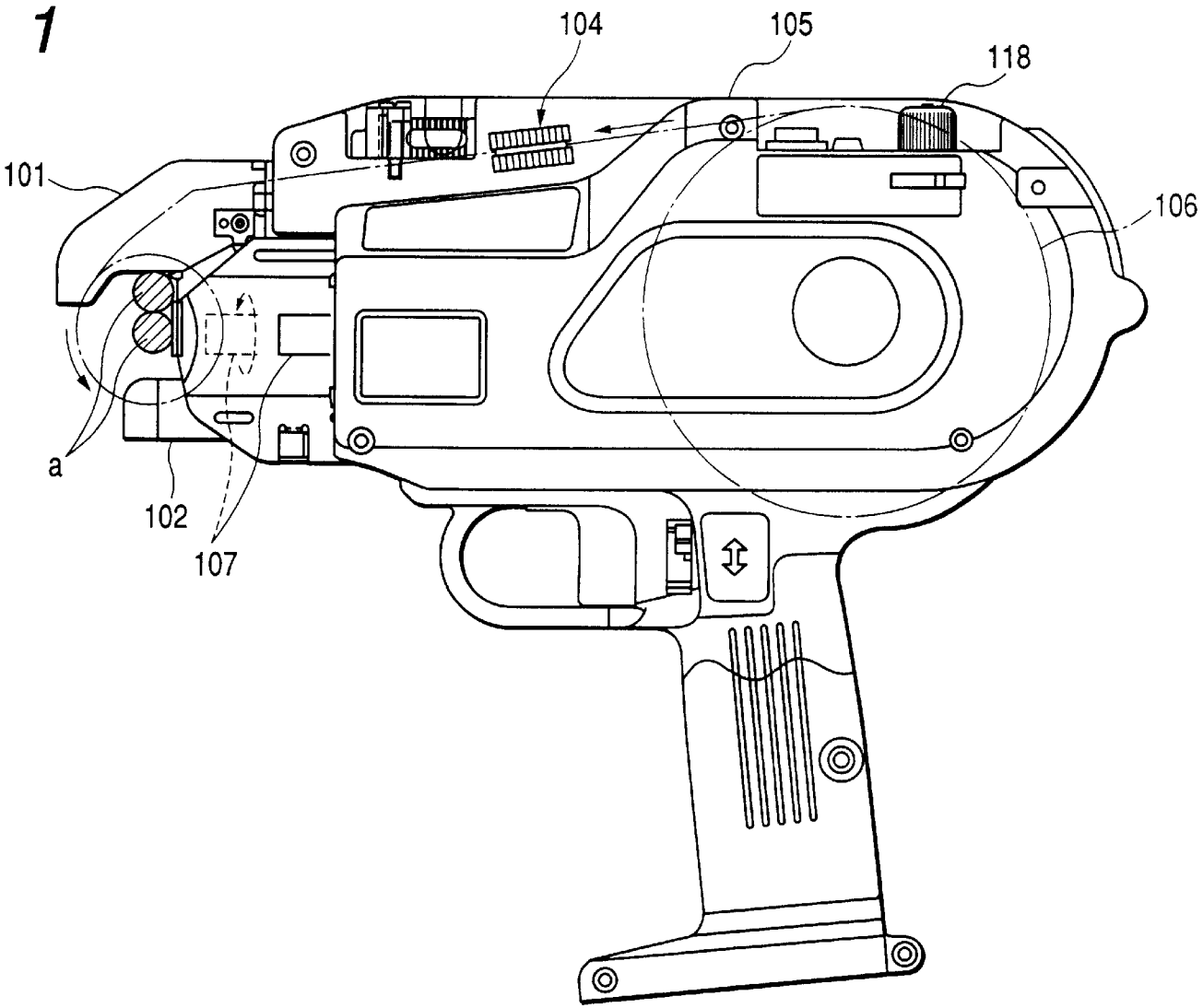
FIG. 1 is a side view showing a binding machine for reinforcing bar of the present invention.

FIG. 1 is a view showing a first embodiment of a binding machine for reinforcing bars. In this binding machine for reinforcing bars, binding operation is conducted as follows. Reinforcing bars "a" are set between the bending guide arm 101 and the auxiliary arm 102 arranged under the bending guide arm 101. After that, the feed means 104 is operated, and wire "b" is sent out from the wire roller 106 for binding, which is arranged in the binding machine body 105, through the bending guide arm 101 in such a manner that wire "b" is sent out in a loop-shape and wound round the reinforcing bars "a". Further, a portion of the wire loop is held and twisted by the twisting means 107, so that reinforcing bars "a" can be bound by a predetermined binding force.

Figure 2:
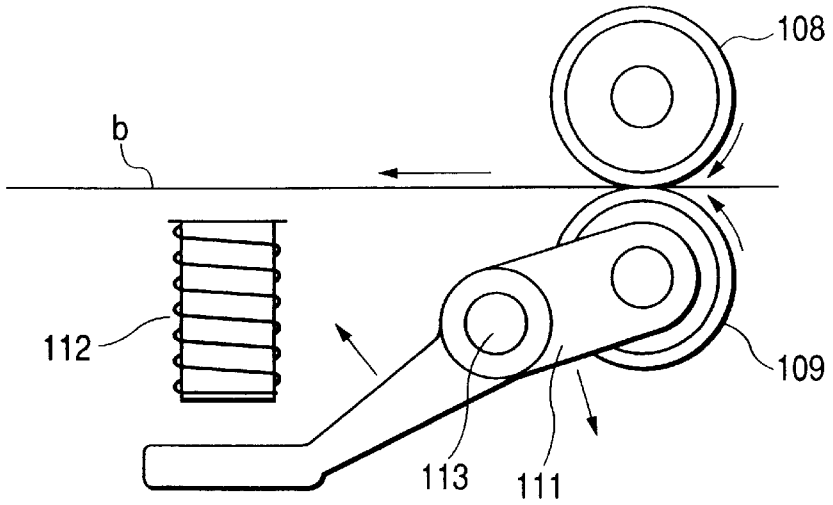
FIG. 2 is a plan view showing a wire feed adjusting mechanism for the binding machine for reinforcing bars.
Figure 3:
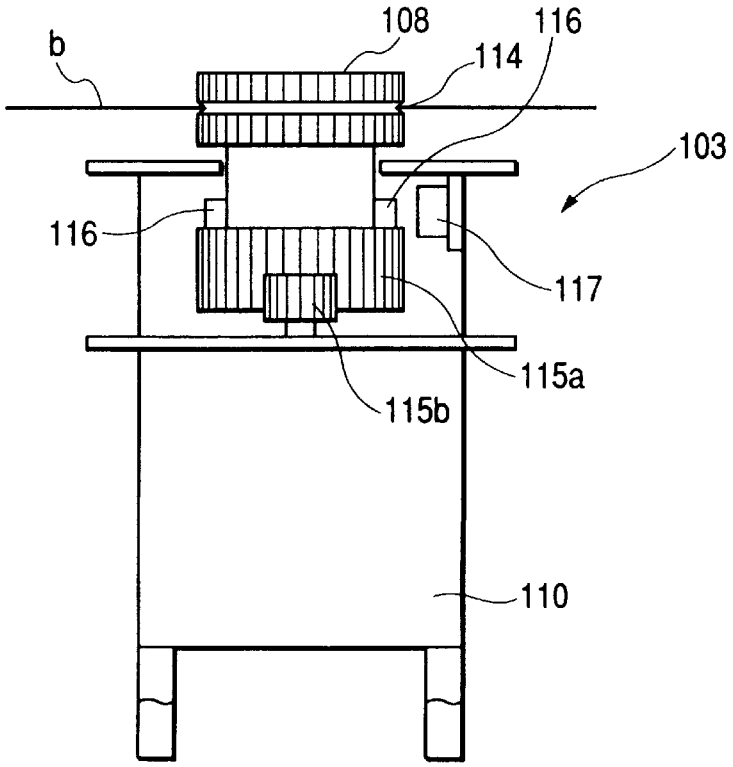
FIG. 3 is a side view showing a primary portion of the wire feed adjusting mechanism of the binding machine for reinforcing bars.

As shown in FIGS. 2 and 3, the feed means 104 for feeding wire "b" is composed as follows. There are provided a pair of feed gears 108, 109, the diameters of which are the same, which can be engaged with and disengaged from each other. When they are engaged with each other, the feed gear 108 on the drive side is rotated by the electric motor 110, so that the feed gear 109 on the idle side can be simultaneously rotated. Wire "b" is interposed between the outer circumferential grooves 114 of the feed gears 108, 109 and sent out onto the bending guide arm 101 side by the torque given from the feed gears. The feed gear 109 on the idle side is connected with the electromagnet 112 via the link 111. When the solenoid 112 is not electrified, the feed gear 109 on the idle side is pushed so that it can be engaged with the feed gear 108 on the drive side. Therefore, binding wire "b" can be effectively fed. On the other hand, when the solenoid 112 is electrified, the end portion of the link 111 is attracted by the solenoid 112, and the link 111 is oscillated round the support shaft 113 arranged at the center of the link. Due to the foregoing, the feed gear 109 on the idle side is separated from the feed gear on the drive side. Therefore, the feeding motion of binding wire "b" is stopped.

In this connection, the reduction gear 115*a* is attached to the rotary shaft 114 of the feed gear 108 on the drive side and meshed with the output gear 115*b* attached to the output shaft of the electric motor 110.

Next, at a position close to the above feed means 104, there is provided a feed adjusting mechanism 103 for adjusting a feed of binding wire "b". This feed adjusting mechanism 103 includes: a plurality of magnets 116 attached at regular intervals to the periphery of the rotary shaft 114 of the feed gear 108 on the drive side composing the feed means 104; a magnetic sensor 117 arranged outside the position at which the magnet 116 is attached; and a rotary switch 118 (shown in FIG. 1). The rotating speed of the feed gears 108, 109 is detected by the magnet 116 and the magnetic sensor 117, and the rotating speed of the feed gear is changed by the rotary switch 118.

The magnet 116 is rotated together with the feed gears 108, 109 when binding wire "b" is fed. Magnetism of the magnet 116 is detected by the magnetic sensor 117, and the rotating speed of the feed gear 108, 109 is measured by the result of detection by the magnetic sensor 117, so that a feed of binding wire "b" can be known by the rotating speed of the feed gears 108, 109. Accordingly, when a predetermined feed is measured, the solenoid 112 is electrified so that the feed gear 109 on the idle side is separated from the feed gear 108 on the drive side and at the same time the electric motor 110 is stopped. Due to the foregoing, a predetermined length of binding wire can be fed. In order to change the feed of binding wire "b", time to electrify the solenoid 112 may be changed by the rotary switch 118.

In this connection, in order to stop feeding wire "b", the electric motor 110 is stopped. However, even if the electric motor 110 is switched off, inertia is still acting. Therefore, it is impossible to stop the rotation of the feed gear 108 simultaneously with the switching off of the electric motor 110. However, when the feed gear 109 on the idle side is separated by the action of the solenoid 112, the feeding of the wire can be stopped simultaneously with the switching off of the electric motor 110. Due to the foregoing, the feeding of the binding wire can be adjusted with high accuracy.

In this connection, adjustment of the feed of binding wire "b" is conducted according to the diameter of the reinforcing bars or the diameter of the loop of the reinforcing bars. The diameter of the reinforcing bars can be known by measuring it directly, and the loop diameter can be known by the tensile strength of binding wire "b". Therefore, the most appropriate feed maybe obtained by adjusting the rotary switch 18.

Figure 4:
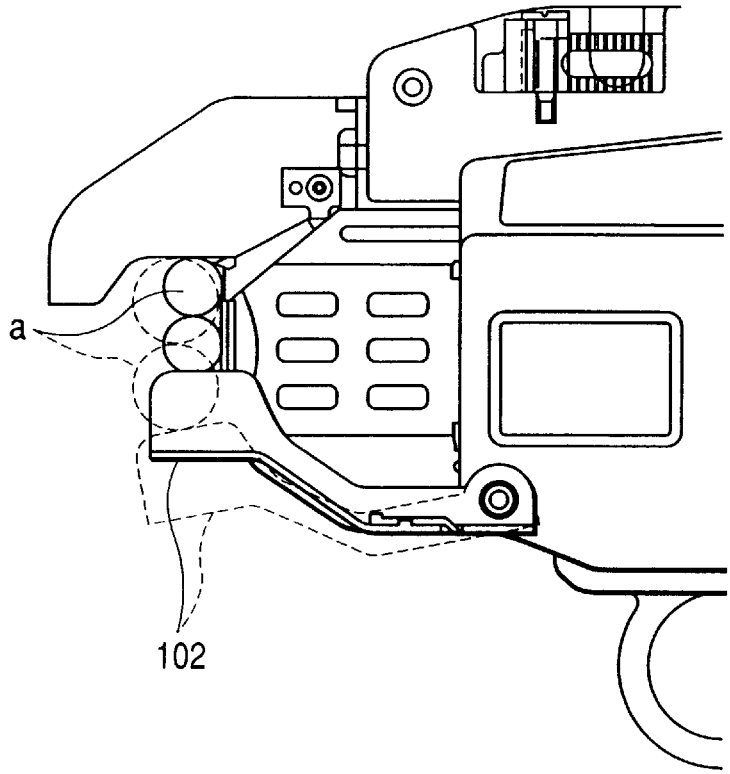
FIG. 4 is a schematic illustration explaining an example of the discriminating mechanism to discriminate the diameter of a reinforcing bar.
Figure 5B:
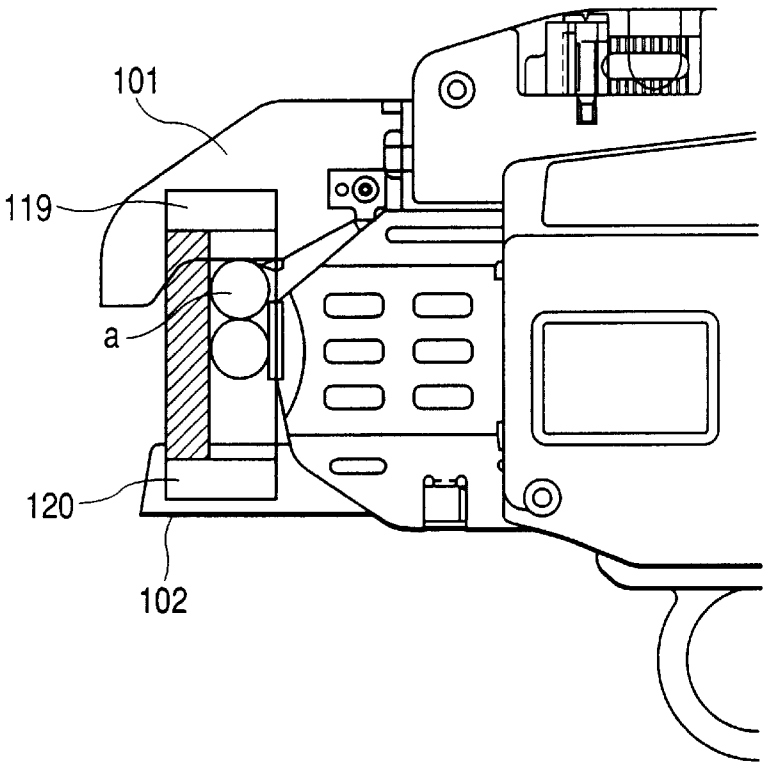
FIG. 5(*a*) and FIG. 5(*b*) are schematic illustrations for explaining another example of the discriminating mechanism to discriminate the diameter of a reinforcing bar.
Figure 5A:
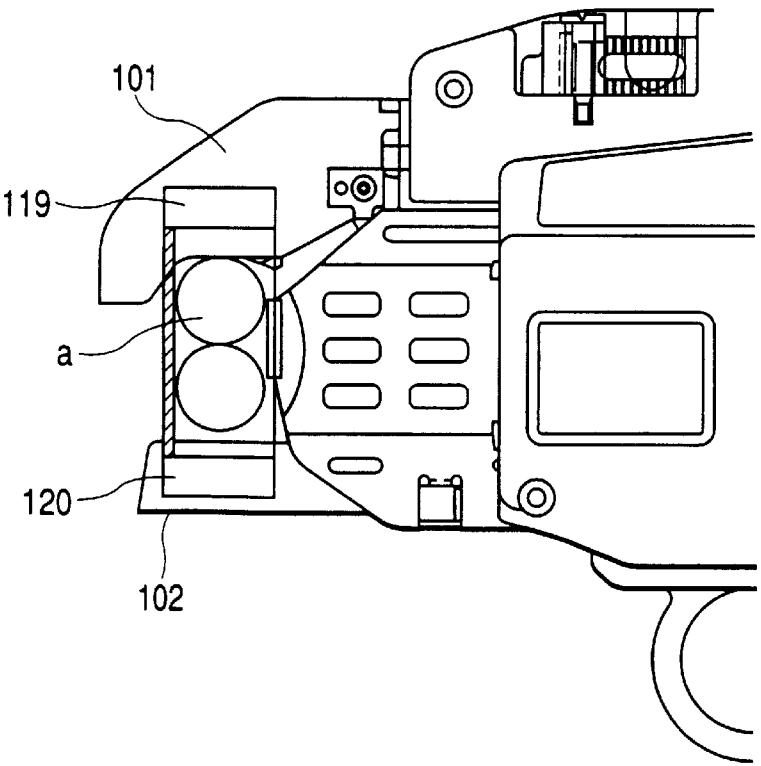

However, the following arrangement may be adopted. For example, when the auxiliary arm 102 is composed so that it can be oscillated at the fulcrum of its base portion as shown in FIG. 4, it is possible to discriminate whether the diameter of the reinforcing bar "a" is large or small with an open angle of the auxiliary arm 102. Therefore, it is possible to automatically adjust a feed of the binding wire according to the result of this discrimination. Alternatively, the following arrangement may be adopted. As shown in FIGS. 5(*a*) and 5(*b*), optical sensors are attached to the bending guide arm 101 and the auxiliary arm 102. A quantity of light, which has been emitted from the light emitting element 119 and transmitted through the reinforcing bars, is different according to the diameter of the reinforcing bars, wherein the quantity of light is expressed by hatched lines in the drawing. Therefore, when a quantity of transmitted light is detected by the light receiving element 120, it is possible to discriminate whether the diameter of reinforcing bar "a" is large or small.

Figure 6:
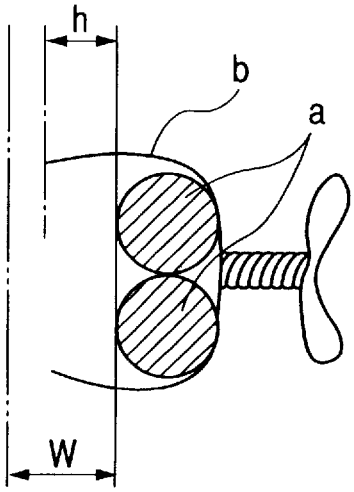
FIG. 6 is a schematic illustration for explaining a state in which reinforcing bars are bound by a feed adjusting mechanism.

As described above, a position of the end portion of the binding wire after the completion of binding operation can be adjusted according to the diameter of the reinforcing bar and the diameter of the loop of the binding wire by the wire feed adjusting mechanism. Therefore, as shown in FIG. 6, height "h" of the end portion of binding wire "b" with respect to reinforcing bar "a" can be reduced. Accordingly, when concrete is placed, height "h" of the end portion of binding wire "b" can be reduced smaller than thickness W of concrete. When the size of the end portion of the binding wire is large, there is a possibility that the end portion of the binding wire is exposed from the surface of cured concrete. However, when the above structure is adopted, there is no possibility that the binding wire is exposed to the outside air. Therefore, it is possible to prevent the deterioration of concrete caused by corrosion of the binding wire.

In the above embodiment, the binding wire is sent out from the guide, which is arranged at the end of the binding machine, and wound round the reinforcing bars three times, however, it should be noted that the binding machine of the present invention is not limited to the above specific embodiment. When the diameter of the reinforcing bars is small or when the reinforcing bars are temporarily bound so that a strong binding force is not required, an operator of the binding machine may arbitrarily determine the number of the binding of the reinforcing bars so that the number can be not more than three times. When the diameter of the reinforcing bars is large or when a strong binding force is required, the operator of the binding machine may arbitrarily determine the number of the binding of the reinforcing bars so that the number can be not less than three times or four times. In this way, a binding force required by the operator can bear arbitrarily set. Further, the feed of the binding wire can be set according to the application. Due to the foregoing, a quantity of the binding wire to be used can be economized. The above feed adjusting mechanism can be applied even to the above box nailing machine.

Figure 7:
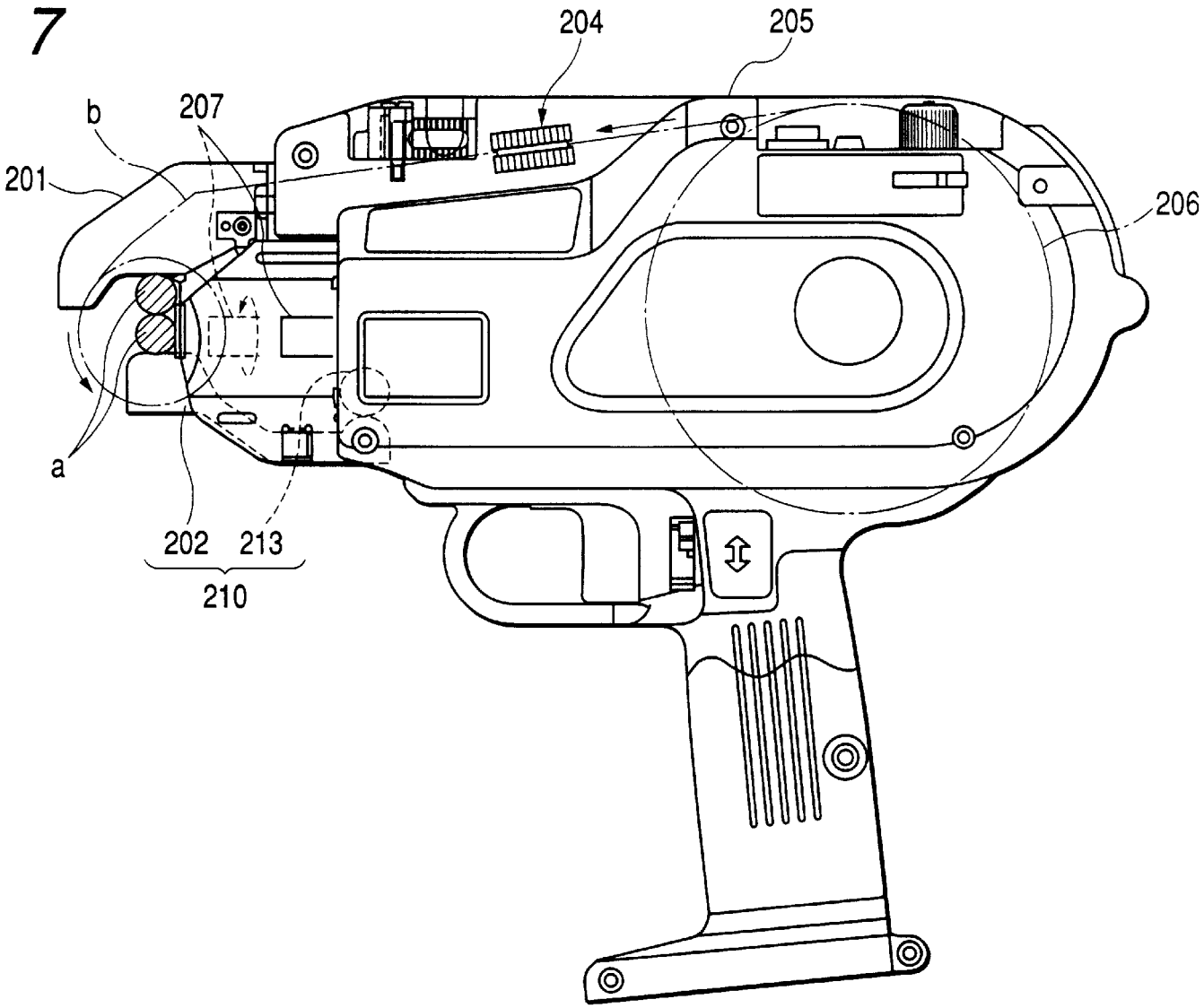
FIG. 7 is a side view showing a binding machine for reinforcing bars according to the present invention.

Hereinafter, another embodiment of the present invention will be described. FIG. 7 is a view showing a binding machine for reinforcing bars according to a second embodiment of the present invention. In this binding machine for reinforcing bars, binding operation is similar to the above first embodiment and conducted as follows. Reinforcing bars "a" are set between the bending guide arm 201 and the auxiliary arm 202 arranged under the bending guide arm 201. After that, the feed means 204 is operated, and wire "b" is sent out from the binding wire roller 206, which is arranged in a binding machine body 205, through the bending guide arm 201 in such a manner that wire "b" is sent out in a loop-shape and wound round the reinforcing bars "a". Further, a portion of the wire loop is held and twisted by the twisting means 207, so that reinforcing bars "a" can be bound by a predetermined binding force.

Figure 8:
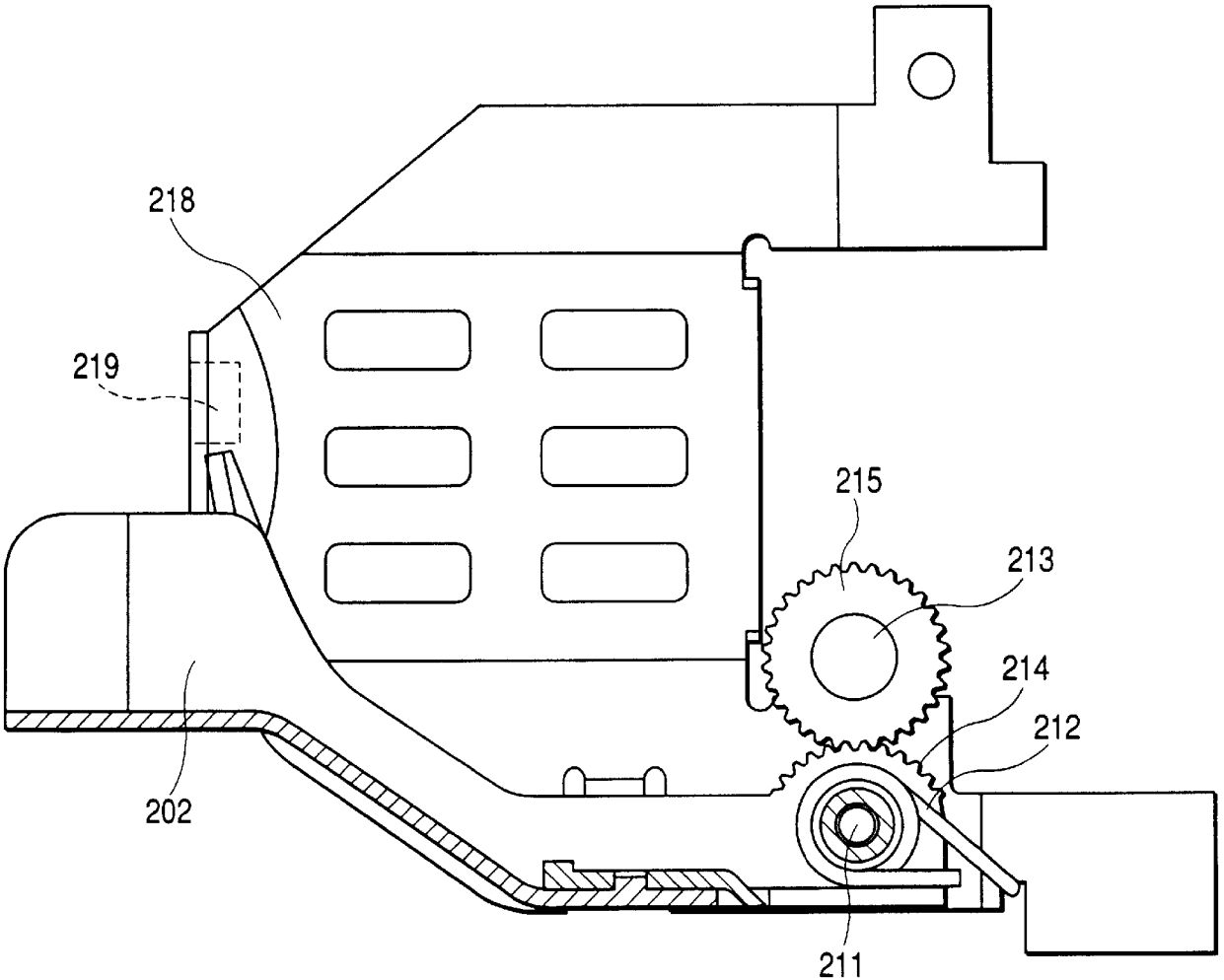
FIG. 8 is a schematic illustration showing an example of the discriminating mechanism.

In this connection, in the above binding machine 205, there is provided a discriminating mechanism 210 for discriminating the diameter of reinforcing bar "a". As shown in FIG. 8, this discriminating mechanism 210 includes: an auxiliary arm 202 which is pivotally supported by the support shaft 211 at the end of the binding machine body 205 so that the auxiliary arm 202 can be rotated round the support shaft 211 in the upward and downward direction, wherein this auxiliary arm 202 is always pushed by the spring member 12 so that it can be rotated upward; and a measuring means 213 for measuring an open angle of the auxiliary arm 202.

The measuring means 213 is composed of a potentiometer. This potentiometer 213 is directly connected with the shaft of the gear 215 which is meshed with the arc-shaped gear 214 concentrically attached to the support shaft 211 at the rear end portion of the auxiliary arm 202. Due to the above structure, a quantity of rotation of the auxiliary arm 202 is proportional to a measured value of the potentiometer 213. The resistance of the potentiometer 213 is converted into a voltage, and the diameter of reinforcing bar "a" can be discriminated by this voltage. For example, a table of reinforcing bar diameter versus voltage is previously made from the actually measured values, and the measured voltage is referred to the voltage on the table. In this way, the diameter of reinforcing bar "a" can be discriminated.

It should be noted that the measuring means is not limited to the potentiometer 213, for example, the measuring means 213 may be composed of a rotary encoder.

There is provided a contact section 218 at an end of the binding machine body 205 between the upper bending guide arm 201 and the lower auxiliary arm 202. In this contact section 218, there is provided a sensor (for example, a contact switch) 219 for detecting that reinforcing bar "a" comes into contact with the contact section 218. A control section not shown in the drawing reads an open angle (resistance (voltage) of the potentiometer 213) of the auxiliary arm when this sensor 219 is operated. The control section discriminates the diameter of reinforcing bar "a" from the thus read open angle and adjusts a feed of reinforcing bar "a" conducted by the feed means 204 and also adjusts a binding force (a quantity of rotation of the twisting means or an electric current of the motor for judging the stoppage of supply of electric power to the motor which is a drive force) generated by the twisting means 7.

Figure 9A:
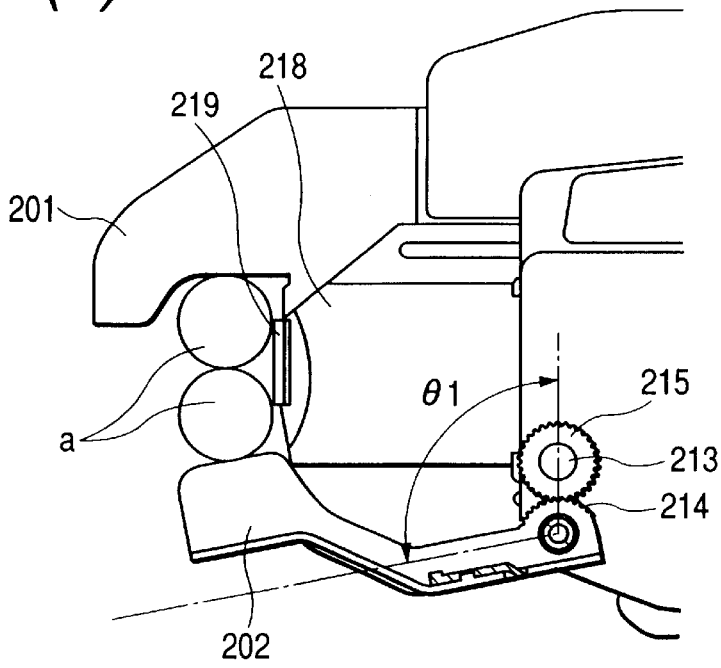
FIGS. 9(*a*) and 9(*b*) are schematic illustrations for explaining a state of operation of the above discriminating mechanism.
Figure 9B:
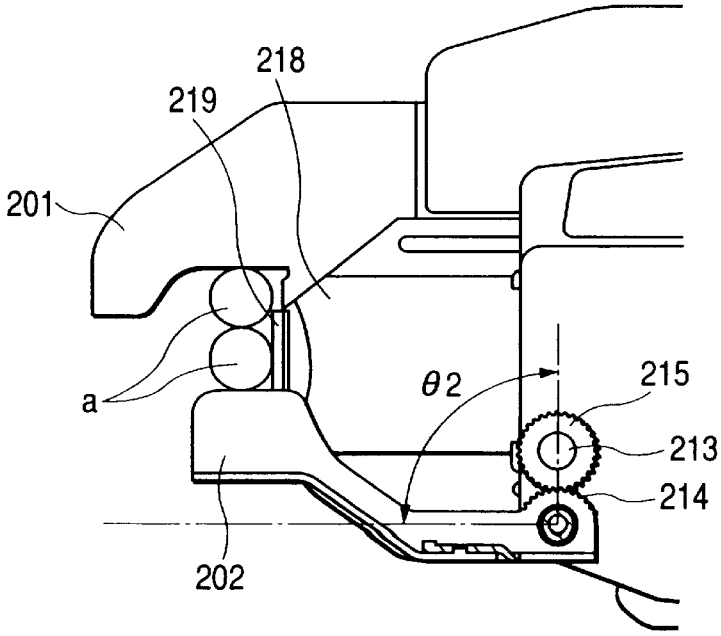

Next, the use of the above binding machine for reinforcing bars will be explained. First, at the initial stage, open angle θ, which is an angle formed by the auxiliary arm, is set as shown in FIG. 8. Then, while the end portion of the binding machine 205 is being pressed against reinforcing bars "a" to be bound, reinforcing bars "a" are interposed between the bending guide arm 201 and the auxiliary arm 202 arranged under the bending guide arm 201. The auxiliary arm 202 is forcibly rotated by the reinforcing bars "a", which have been pushed between the bending guide arm 201 and the auxiliary arm 202, resisting the spring member 212. Therefore, reinforcing bars "a" are supported by the bending guide arm 201 and the auxiliary arm 202 in such a manner that the reinforcing bars "a" are pinched by the bending guide arm 201 and the auxiliary arm 202. At this time, as shown in FIGS. 9(*a*) and 9(*b*), open angle θ of the auxiliary arm 202 is different according to the diameter of the reinforcing bars (θ1>θ2). When the binding machine body 205 is pressed against the reinforcing bars "a" until the reinforcing bars "a" come into contact with the sensor 219, the control section reads out open angle θ (voltage) of the auxiliary arm 202 at the point of time when the sensor 219 is operated. The diameter of reinforcing bars "a" is discriminated by the thus read open angle θ (voltage), and a feed of reinforcing bars "a" conducted by the feed means 204 is adjusted and a binding force generated by the twisting means 207 is also adjusted. In the case of thick reinforcing bars "a", the feed of reinforcing bars "a" is increased, and in the case of thin reinforcing bars "a", the feed of reinforcing bars "a" is decreased. In accordance with that, the binding force of the twisting means 207 (a quantity of rotation of the twisting means, or an electric current of the motor for judging the stoppage of electric power supply to the motor which is a drive force) is adjusted so that reinforcing bars "a" can be twisted by an appropriate intensity of torque.

Due to the foregoing, it becomes possible to use an appropriate quantity of wire "b" according to the diameter of reinforcing bar "a", and at the same time, operation time of the twisting means 207 is not wasted, and consumption of the battery can be suppressed. Therefore, the working efficiency can be enhanced.

Figure 10:
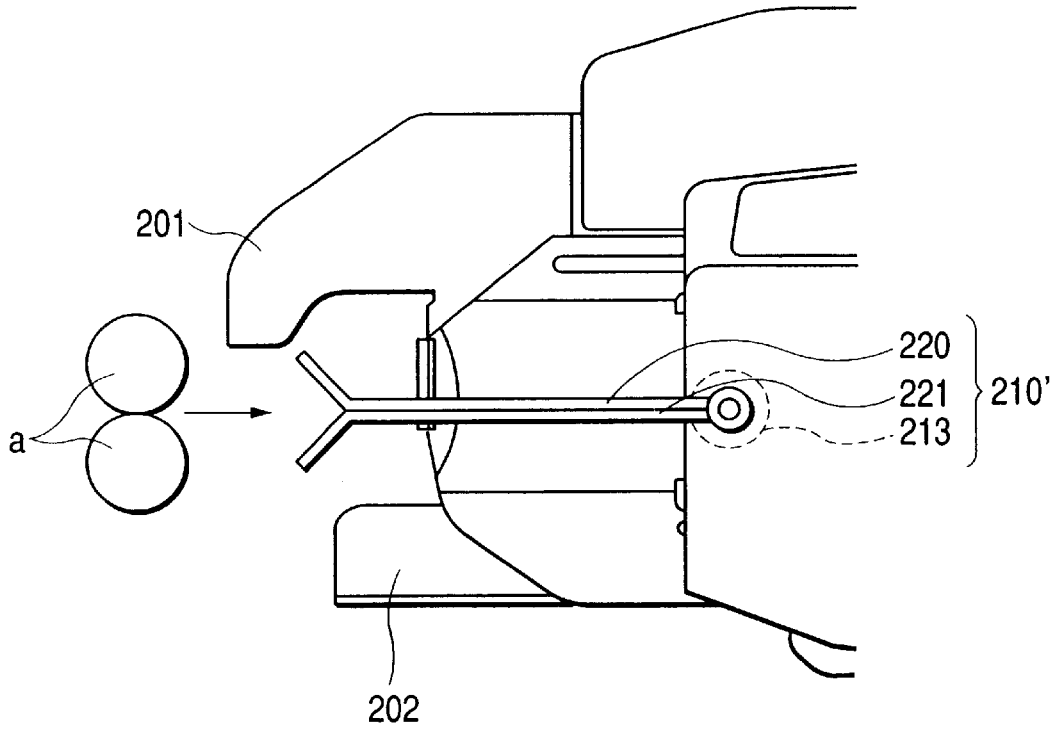
FIG. 10 is a schematic illustration for explaining another example of the discriminating mechanism.
Figure 11A:
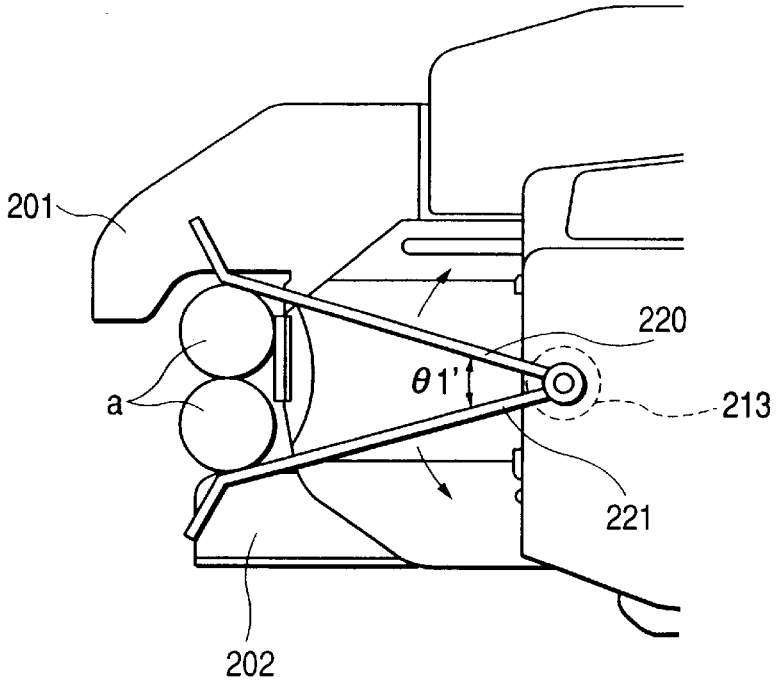
FIGS. 11(*a*) and 11(*b*) are schematic illustrations for explaining a state of operation of the above discriminating mechanism.
Figure 11B:
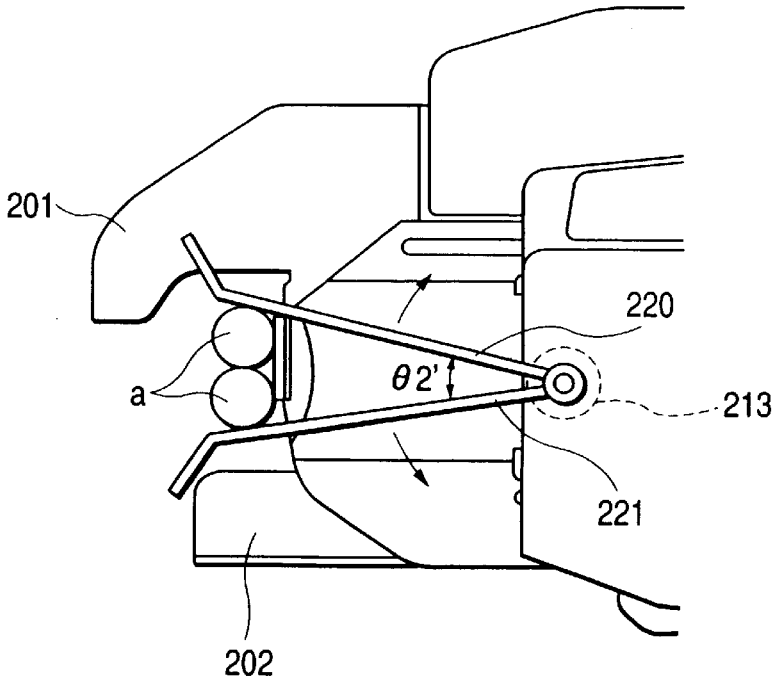
Figure 12A:
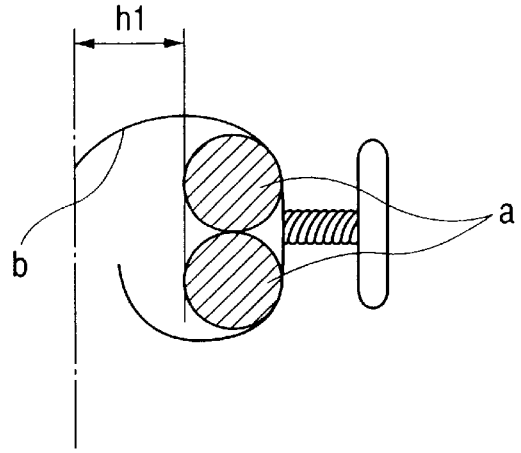
FIGS. 12(*a*) and FIG. 12(*b*) are schematic illustrations for comparing the height from a reinforcing bar to an end of a wire in the case of a reinforcing bar of a large diameter with the height from a reinforcing bar to an end of a wire in the case of a reinforcing bar of a small diameter.
Figure 12B:
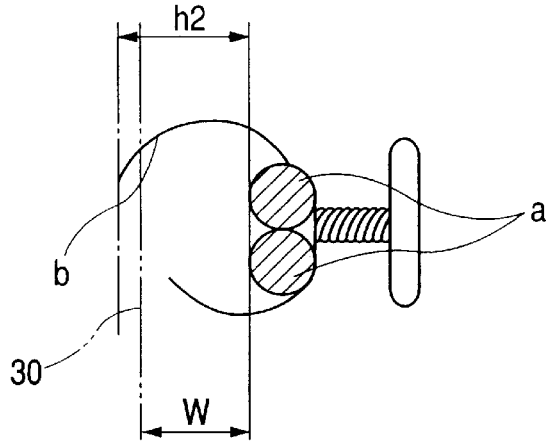
Figure 13:
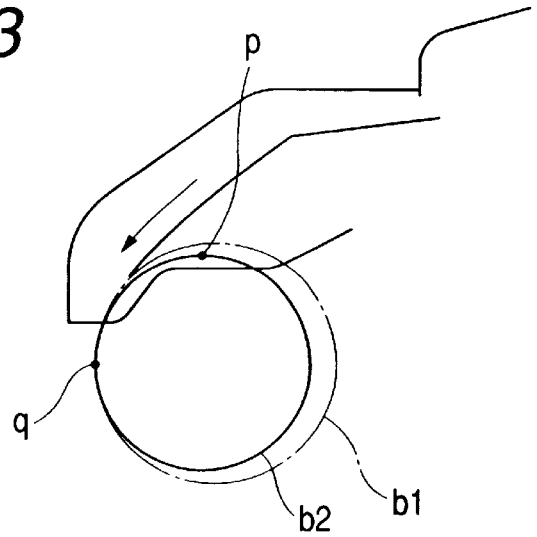
FIG. 13 ia a schematic illustration for comparing the end portion of a wire in the case of a large loop diameter with the end portion of a wire in the case of a small loop diameter.
Figure 14A:
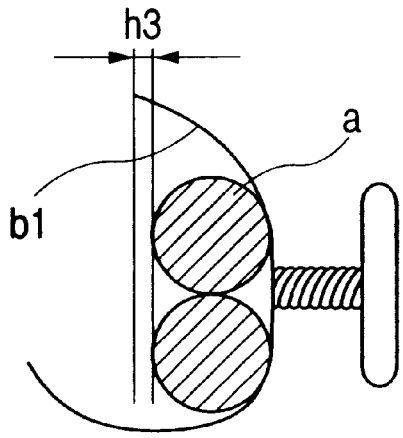
FIG. 14(*a*) and FIG. 14(*b*) are schematic illustrations for comparing the height from a reinforcing bar to an end of a wire in the case of a large loop diameter with the height from a reinforcing bar to an end of a wire in the case of a small loop diameter.
Figure 14B:
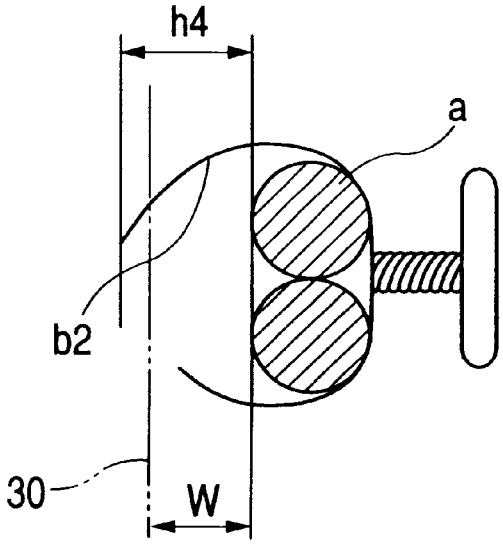

FIG. 10 is a view showing another example of the discriminating mechanism. This discriminating mechanism 210' includes: a pair of levers 220, 221, the forward end portions of which are respectively bent in opposite directions to each other; and a measuring means 213 for measuring an open angle formed between the levers 220, 221. The above pair of levers 220, 221 are always pushed by a pushing means, not shown, so that they can be closed to each other. As shown in FIGS. 11(*a*) and 11(*b*), when the front end portions of the levers 220, 221 are pressed against reinforcing bars "a", the levers 220, 221 are expanded to each other by reinforcing bars "a" in the opposite directions, and open angle θ' formed between the levers 220, 221 is changed by the diameter of the reinforcing bars (θ1'>θ2'). This open angle θ' of the levers 220, 221 is measured by the measuring means 213. This measuring means 213 may be composed of a potentiometer in the same manner as that of the aforementioned discriminating means 210.

According to the above discriminating mechanism, when the forward end portion of the binding machine body is pressed against reinforcing bars "a", the reinforcing bars "a" are interposed between the bending guide arm 201 and auxiliary arm 202 while the reinforcing bars "a" are expanding the levers 220, 221. According to the open angle formed between the levers 220, 221, an amount of operation of the potentiometer 213 is changed. This amount of operation of the potentiometer 213 is converted into a resistance, and this resistance is converted into a voltage. At the point of time when the sensor 219 is turned on, the control section reads out the open angle (voltage) of the levers. The diameter of the reinforcing bars is discriminated by this voltage. According to the result of discrimination, the feed means and the twisting means are adjusted. Due to the foregoing, the reinforcing bars can be bound under the most appropriate condition, that is, the reinforcing bars can be bound effectively.

In any discriminating mechanisms, no photo-sensors are used for the measuring means 213, but mechanical sensors such as a potentiometer are used. Therefore, even if the sensor is used in a poor dusty environmental condition, measurement can be stably made without being affected by the environment.

According to the second embodiment of the present invention, when reinforcing bars are bound, the diameter of the reinforcing bars is automatically measured, and the feed of the wire and the intensity of the binding force are adjusted according to the diameter of the reinforcing bars. Accordingly, it is unnecessary to manually adjust the feed of the wire and the intensity of the binding force according to the diameter of the reinforcing bars. Further, since the feed of the wire and the intensity of fastening torque can be appropriately adjusted, it becomes possible to suppress the consumption of the wire. Furthermore, operation time of the twisting means can be appropriately set. Therefore, the working efficiency can be enhanced.

While only certain embodiments of the invention has been specifically described herein, it will be apparent that numerous modifications may be made thereto without departing from the spirit and scope of the invention.

The present invention is based on Japanese Patent Applications No. Hei. 11-209930 and 11-327496 which are incorporated herein by reference.

What is claimed is:

1. A binding machine for reinforcing bars in which a binding wire is sent outside the reinforcing bars from a bending guide arm arranged at an end of a binding machine body so that the binding wire can be formed into a loop and then a portion of the loop is twisted so as to bind the reinforcing bars, said binding machine comprising a discriminating mechanism for discriminating the diameter of the reinforcing bars arranged at an end of the binding machine body, wherein a feed and a binding force of the wire is controlled according to a result of discrimination conducted by the discriminating mechanism.

2. A binding machine for reinforcing bars, comprising:

a binding machine body;

a bending guide arm arranged at an end of said binding machine body;

a feed gear;

a feed adjustment mechanism; and a twisting mechanism, wherein a binding wire is sent outside reinforcing bars from said bending guide arm and is formed into a loop, and then a portion of the loop is twisted by said twisting mechanism so as to bind the reinforcing bars, and wherein said feed adjustment mechanism adjusts a feed of the binding wire according to one of a diameter of the reinforcing bars and a diameter of the loop of the binding wire wound around the reinforcing bars by disengaging said feed gear from said binding wire.

3. A binding machine for reinforcing bars, comprising:

a binding machine body;

a bending guide arm arranged at an end of said binding machine body;

a feed adjustment mechanism including:

a motor, a first feed gear rotated by said motor, a second freed gear engageable with said first feed gear, a link connected to said second feed gear, an electromagnet; and a twisting mechanism, wherein a binding wire is sent outside reinforcing bars from said bending guide arm and is formed into a loop, and then a portion of the loop is twisted by said twisting mechanism so as to bind the reinforcing bars, wherein said feed adjustment mechanism adjusts a feed of the binding wire according to one of a diameter of the reinforcing bars and a diameter of the loop of the binding wire wound around the reinforcing bars, wherein said second feed gear is engaged with said first feed gear in order to feed the binding wire when said electromagnet is not electrified, and wherein said second feed gear is attracted by said electromagnet via said link and disengaged with said first feed gear in order to stop feeding the binding wire when said electromagnet is electrified.

4. The binding machine for reinforcing bars according to claim 3, wherein said feed adjustment mechanism further comprising:

a rotary shaft of said first feed gear;

a plurality of magnets attached to the periphery of said rotary shaft;

a magnetic sensor, wherein the rotating speed of said first and second feed gears is detected by said magnets and the magnetic sensor.

5. A binding machine for reinforcing bars, comprising:

a binding machine body;

a bending guide arm arranged at an end of said binding machine body;

a feed adjustment mechanism; and a twisting mechanism, wherein a binding wire is sent outside reinforcing bars from said bending guide arm and is formed into a loop, and then a portion of the loop is twisted by said twisting mechanism so as to bind the reinforcing bars, wherein said feed adjustment mechanism adjusts a feed of the binding wire according to one of a diameter of the reinforcing bars and a diameter of the loop of the binding wire wound around the reinforcing bars, and a discriminating mechanism discriminating the diameter of the reinforcing bars, wherein a feed and a binding force of the binding wire is controlled according to the diameter discriminated by said discriminating mechanism.

6. The binding machine for reinforcing bars according to claim 5, wherein said a discriminating mechanism includes:

at least one measuring arm pivotally attached to said binding machine body;

a measure measuring an open angle formed by said measuring arm before the reinforcing bar is bound, wherein the diameter of the reinforcing bar is discriminated by the open angle.

7. The binding machine for reinforcing bars according to claim 6, wherein said measuring arm is an auxiliary arm opposite to said bending guide arm, and wherein the open angle is formed with respect to said binding machine body.

8. The binding machine for reinforcing bars according to claim 6, wherein said binding machine further includes a contact section disposed between said bending guide arm and said auxiliary arm, and wherein a sensor is provided in said contact section for detecting that the reinforcing bar comes into contact with said contact section.

9. The binding machine for reinforcing bars according to claim 6, wherein said measuring arms are a pair of levers, forward end portions of the levers being respectively bent in opposite directions to each other, the forward end portions being contacted with the reinforcing bars before the reinforcing bar is bound, and wherein said discriminating mechanism further includes a pusher pushing said levers so that said levers can be closed each other, wherein the diameter of the reinforcing bar is discriminated by the open angle formed between the levers.

10. The binding machine for reinforcing bars according to claim 6, where in the measure is a potentiometer connected to said measuring arm.

11. The binding machine for reinforcing bars according to claim 6, wherein the measure is a rotary encoder connected to said measuring arm.

12. A binding machine for reinforcing bars, comprising:

a binding machine body;

a bending guide arm arranged at an end of said binding machine body;

a feed adjustment mechanism; and a twisting mechanism, wherein a binding wire is sent outside reinforcing bars from said bending guide arm and is formed into a loop, and then a portion of the loop is twisted by said twisting mechanism so as to bind the reinforcing bars, wherein said feed adjustment mechanism adjusts a feed of the binding wire according to one of a diameter of the reinforcing bars and a diameter of the loop of the binding wire wound around the reinforcing bars, and an auxiliary arm opposite to said binding guide arm;

two optical sensors respectively attached to said bending guide arm and said auxiliary arm, one of said optical sensors being a light emitting element and the other of said optical sensors being a light receiving element, wherein the diameter of the reinforcing bar is detected by a quantity of light detected by the light receiving element, the light being emitted from the light emitting element.

* * * * *